United States Patent [19]

Shaw

[11] Patent Number: 4,830,053

[45] Date of Patent: May 16, 1989

[54] FLUIDIC DEVICES

[76] Inventor: Hugh M. Shaw, 48 Sergeants Lane, Whitefield, Manchester, England

[21] Appl. No.: 112,497

[22] Filed: Oct. 22, 1987

Related U.S. Application Data

[63] Continuation of Ser. No. 899,444, Aug. 22, 1986, abandoned.

[30] Foreign Application Priority Data

Aug. 23, 1985 [GB] United Kingdom ..... 8521164

[51] Int. Cl.[4] ..... F15C 1/16

[52] U.S. Cl. ..... 137/808; 137/812; 376/281; 376/402; 376/463

[58] Field of Search ..... 137/808, 812; 376/230, 376/281, 336, 337, 402, 463

[56] References Cited

U.S. PATENT DOCUMENTS

| | | | |
|---|---|---|---|
| 3,386,290 | 6/1968 | Egli | 137/808 |
| 3,424,182 | 1/1969 | Mayer | 137/812 |
| 3,496,961 | 2/1970 | Erwin | 137/812 |
| 3,515,158 | 6/1970 | Utz | 137/812 |
| 3,712,321 | 1/1973 | Bauer | 137/812 |
| 3,722,522 | 3/1973 | Randall | 137/812 |
| 3,986,404 | 10/1976 | Heinecke | 137/812 |
| 4,112,977 | 9/1978 | Syred et al. | 137/812 |

FOREIGN PATENT DOCUMENTS

| | | | |
|---|---|---|---|
| 2041620 | 9/1980 | United Kingdom | 137/808 |

OTHER PUBLICATIONS

"Applying Fluidics to Reactor Safety and Reprocessing", *Nuclear Engineering Int'l.*, Dec. 1984, pp. 27–28.

*Primary Examiner*—Deborah L. Kyle
*Assistant Examiner*—Richard W. Wendtland
*Attorney, Agent, or Firm*—King & Schickli

[57] ABSTRACT

A fluidic device, in particular a vortex diode, has a vortex chamber formed by spaced apart end walls and a peripheral side wall. An axial port is provided in one end wall and a further port permitting tangential flow into or out of the chamber is provided in the other end wall.

5 Claims, 1 Drawing Sheet

FLUIDIC DEVICES

This is a continuation of application Ser. No. 899,444, filed Aug. 22, 1986, abandoned.

The present invention concerns fluidic devices, in particular vortex diodes.

BACKGROUND OF THE INVENTION

Vortex diodes are known fluidic devices which function to control fluidic flows. A conventional vortex diode comprises a cylindrical vortex chamber having a tangential port or ports in a side wall and an axial port in an end wall.

Conventional fluidic devices such as vortex diodes can be difficult to locate in restricted or confined locations. It is the aim of the present invention to provide a fluidic device which overcomes such difficulty.

FEATURES AND ASPECTS OF THE INVENTION

According to the present invention a fluidic device comprises a vortex chamber having spaced apart end walls and a peripheral side wall, an axial port in one of the end walls and at least one further port permitting tangential flow into or out of the chamber, in which the further port is in the other end wall.

DESCRIPTION OF THE DRAWINGS

The invention will be described further, by way of example, with reference to the accompanying drawings; in which.

DESCRIPTION OF THE PREFERRED EMBODIMENT

Figure 1:
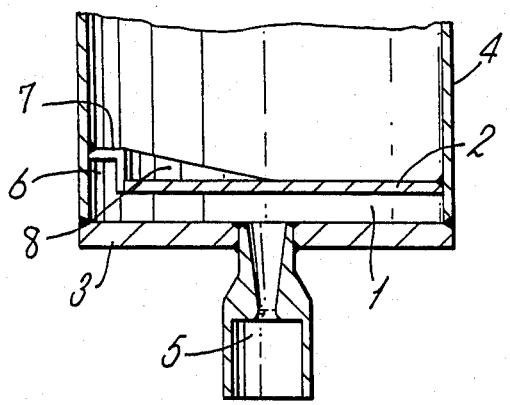
FIG. 1 is a section through an embodiment of a vortex diode.
Figure 2:
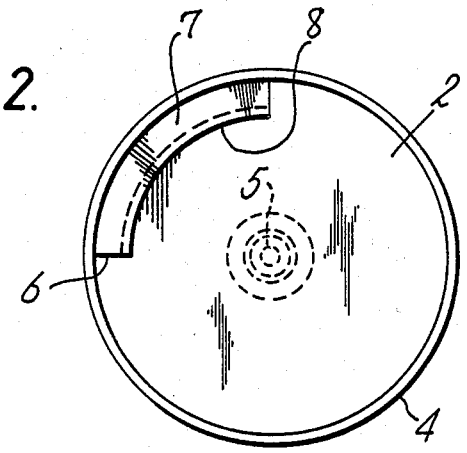
FIG. 2 is a plan of FIG. 1.

In the drawings, a vortex diode comprises a vortex chamber 1 bounded by circular end walls 2 and 3 and a peripheral side wall 4. An axial port 5 is provided in one end wall 3 and a port 6 is provided in the opposite end wall 2 to permit tangential flow into or out of the chamber. The port 6 can be formed by a peripheral portion of the end wall 2 extending over approximately a quadrant thereof with the peripheral portion increasing progressively from the plane of the end wall to a maximum at one end of the port 6. In the illustrated embodiment the port 6 comprises an arcuate cut-out in the periphery of the end wall 2 which is provided with an arcuate inclined hood or cover having an arcuate end wall 7 connected at its inner side to an axial wall 8 extending from wall 2.

The construction is such that a vortex diode can be formed in a confined volume which hitherto has proved inaccessible to or inappropriate for existing conventional vortex diodes. Thus, the confined volume can be a narrow bore fluid flow conduit or pipe such as the cylindrical wall 4. The end wall 2 is welded or otherwise secured to the interior of the wall 4 at a position adjacent the end of the wall 4 and the vortex chamber 1 is completed by welding or otherwise securing the end wall 3 to the end of the cylindrical wall 4.

As a further example, the vortex diode can be secured to a flanged opening in a housing, for example a pump housing. In this arrangement the end wall 3 extends radially beyond the wall 4 to provide a flange which can be bolted to the flanged opening in the housing.

The vortex diode functions as a non-return valve having no moving parts and is therefore very attractive for use in controlling flows of hazardous fluids, such as found in the nuclear industry. Flow entering the tangential port 6 creates a vortex in the chamber 1 before exiting through the axial port 5. The centrifugal reaction of the vortex sets up a pressure difference between the two ports which opposes the flow. This is termed a high resistance path. Flow in the opposite direction from the axial port 5 to the tangential port 6 does not set up a vortex and consequently there is a low resistance to flow through the vortex diode in this direction.

In an alternative construction, not illustrated, the port 6 in the end wall 2 can be formed by machining the wall from a solid block to provide a spiral passageway in the periphery of the block, similar to a screw thread, which provides communication between the opposite sides of the wall and communicates substantially tangentially with the vortex chamber.

A plurality of ports 6 can be provided in the end wall 2, each permitting tangential flow into or out of the vortex chamber.

Although described with reference to a vortex diode the invention is applicable to other forms of fluidic devices. For example, a vortex amplifier comprises a vortex chamber having an axial port, in an end wall, one or more radial ports in a side wall and tangential ports associated with the radial ports. The arrangement of the present invention whereby the tangential ports are formed in the other end wall can be extended to such a device.

I claim:

1. A method of forming a fluidic device comprising providing a fluid flow conduit having a conduit wall, connecting axially spaced end walls across the conduit to define a vortex chamber having an imperforate peripheral wall defined by said conduit wall, providing an axial port in only one of the end walls and providing a tangentially directed port in the other of the end walls opening into said fluid flow conduit such that fluid flowing in the conduit in a first direction flows through the tangentially directed port tangentially into the vortex chamber creating a vortex within said chamber so as to provide relatively high resistance to flow whereas fluid flowing in said conduit in a second direction flows through said axial port axially into said vortex chamber without forming a vortex within said chamber so as to provide a relatively low resistance to flow.

2. A fluidic device mounted within a fluid flow conduit, comprising:

a fluid flow conduit having a conduit wall;

a vortex chamber within said fluid flow conduit having first and second spaced apart end walls and an imperforate peripheral sidewall formed by said conduit wall, said end walls extending across said fluid flow conduit;

an axial port only in said first end wall; and a tangentially directed port in said second end wall adjacent said conduit wall permitting tangential flow into or out of said vortex chamber;

whereby fluid flowing in a first direction through said conduit from said tangentially directed port through said vortex chamber to said axial port creates a vortex in said vortex chamber that sets up a pressure difference between said ports that resists flow whereas fluid flowing in a second direction through said conduit from said axial port through said vortex chamber to said tangentially directed port fails to create a vortex in said vortex chamber so that there is low resistance to flow in said second direction.

3. A fluidic device according to claim 2 in which the conduit wall forms with the second end wall a flow chamber on the axial side of the second end wall remote from the first end wall, a peripherally extending channel defined in part by the side wall and extending from a mouth in communication with the flow chamber to the port in the tangentially directed second end wall, the channel permitting tangential flow between the flow chamber and the vortex chamber.

4. A fluidic device according to claim 3 in which the channel comprises an arcuate wall extending inwardly from the side wall, a substantially axial further wall connecting the arcuate wall and the second end wall, the arcuate wall being inclined towards the second end wall as the arcuate wall extends from one end thereof to the other so that the arcuate wall merges with the second end wall at the other end of the arcuate wall, the side wall, arcuate wall and further wall providing a passage for flow of fluid to the vortex chamber from said mouth to said tangentially directed port.

5. A fluidic device according to claim 4 in which said arcuate wall is formed by a portion of the second end wall further from said first end wall than a second portion of said second end wall, the first and second portions being connected by the further wall.

* * * * *

UNITED STATES PATENT OFFICE

CERTIFICATE OF CORRECTION

Patent No. 4,830,053 Dated May 16, 1989

Inventor(s) Hugh M. Shaw

It is certified that error appears in the above-identified patent and that said Letters Patent is hereby corrected as shown below:

On the title page, add:

-- Assignee: British Nuclear Fuels Plc
Risley, England --.

Signed and Sealed this

Eleventh Day of September, 1990

*Attest:*

HARRY F. MANBECK, JR.

*Attesting Officer*

*Commissioner of Patents and Trademarks*